US005794496A

United States Patent [19]

Arnold

[11] Patent Number: 5,794,496

[45] Date of Patent: Aug. 18, 1998

[54] PAWL MODULE FOR RATCHET WRENCH

[75] Inventor: Robert L. Arnold, Jacobus, Pa.

[73] Assignee: Hand Tool Design Corporation, Wilmington, Del.

[21] Appl. No.: 760,734

[22] Filed: Dec. 5, 1996

[51] Int. Cl.[6] ..... B25B 13/46

[52] U.S. Cl. ..... 81/63.2; 81/60; 81/61; 81/62; 81/63.1; 81/63.2; 81/177.8

[58] Field of Search ..... 81/60, 61, 62, 81/63, 63.1, 63.2, 177.8

[56] References Cited

U.S. PATENT DOCUMENTS

| | | | |
|---|---|---|---|
| Re. 19,341 | 10/1934 | McNaught et al. . | |
| 747,750 | 12/1903 | Murch . | |
| 896,607 | 8/1908 | Zeller . | |
| 1,902,878 | 3/1933 | McNaught et al. . | |
| 2,300,479 | 11/1942 | Wilson . | |
| 2,708,855 | 5/1955 | Fish . | |
| 3,349,653 | 10/1967 | Kaufman et al. . | |
| 4,111,077 | 9/1978 | Cummings et al. . | |
| 4,328,720 | 5/1982 | Shiel . | |
| 4,515,044 | 5/1985 | Harstad . | |
| 4,561,329 | 12/1985 | Lack . | |
| 4,711,145 | 12/1987 | Inoue | 81/177.8 |
| 4,901,608 | 2/1990 | Shieh | 81/177.8 |
| 4,986,147 | 1/1991 | Cooper | 81/63.2 |
| 4,993,288 | 2/1991 | Anderson et al. . | |
| 5,140,875 | 8/1992 | Kim . | |
| 5,178,047 | 1/1993 | Arnold et al. | 81/63.2 |
| 5,499,559 | 3/1996 | Lin | 81/63.1 |
| 5,499,560 | 3/1996 | Aeschliman . | |
| 5,533,427 | 7/1996 | Chow | 81/63.2 |
| 5,626,062 | 5/1997 | Colvin | 81/63.2 |

*Primary Examiner*—James G. Smith
*Assistant Examiner*—Lee Wilson
*Attorney, Agent, or Firm*—Leonard Bloom

[57] ABSTRACT

A low profile ratchet wrench has an opening formed through the head of the wrench. A pawl module having a body, a detent mechanism, a reversing lever and a pawl is received in a portion of the opening. A socket having a first portion with circumferential gear teeth and an integral second portion having an axially formed opening, is removably received in the opening in the head adjacent to the pawl module. Teeth on the pawl in the pawl module cooperate with the gear teeth on the socket. The socket is removably retained in the opening in the head. A method of assembling and using the low profile ratchet wrench is described. The pawl module is used in a breaker bar.

17 Claims, 14 Drawing Sheets

14
26
20
28
24
16
92
20
92
30
54
46
90
88
90
86
78
72
74
76
67
69

PAWL MODULE FOR RATCHET WRENCH

BACKGROUND OF THE INVENTION

The present invention relates to a pawl module for use with a ratchet wrench and, more particularly, to a low profile wrench having a self-contained pawl module.

It is highly desirable to have a ratchet wrench to rapidly tighten and loosen fasteners and to do so without removing the wrench from the fastener. It is particularly advantageous for the ratchet wrench to have a low profile wherein the wrench is more easily used in confined spaces where the height of the combined wrench head and attached socket are factors in being able to tighten and/or loosen a fastener.

One embodiment of a low profile ratchet wrench incorporates a socket with gear teeth formed circumferentially about a portion of the socket. The socket is removably disposed in the head of the wrench wherein the gear teeth on the socket cooperate with teeth on the pawl.

All wrenches of which the applicant is aware have a pawl, detent means and lever irremovably mounted in the head of the wrench.

The applicant is unaware of a pawl module which incorporates the various components into a single unit and which permits simplified installation, maintenance and repair of the pawl.

Thus, there exists a need for a low profile ratchet wrench which has a replaceable pawl module.

BRIEF SUMMARY OF THE INVENTION

It is an object of the present invention to provide a low profile ratchet wrench having a pawl module which is disposed in the head of the ratchet wrench.

In accordance with the teachings of the present invention, there is disclosed a ratchet wrench having a head with an opening therein. A pawl module is disposed in the opening in the head. The pawl module includes a body having a pawl and a detent means disposed therein. A pair of spaced apart, substantially parallel flanges are formed on the body, the flanges extending outwardly from the body. The flanges straddle the head of the wrench wherein the pawl module is retained in the head of the wrench. The pawl module further includes a bore hole formed in the body. A detent means is disposed in the bore hole, the detent means being urged against and engaging a first face of the pawl. Teeth are formed on a second opposite face of the pawl, the teeth on the pawl being oriented toward the opening in the head to permit engagement with gear teeth on a socket disposed in the head. A reversing lever extends through the body and is received in an axial opening in the pawl, wherein the pawl may be rotated between a forward and a reverse position. The first face of the pawl has a pair of adjacent pockets formed therein. The detent means in the bore hole in the body are urged against the first face of the pawl, the detent means cooperating with the first and second pocket as desired. The reversing lever rotates the pawl to select the desired pocket, the pawl thereby being in a forward or a reverse position.

In another aspect, a method of assembling and using the ratchet wrench and socket pawl of the present invention is provided.

In still another aspect, there is disclosed a breaker bar having a handle and a head connected to the handle. The head has a through opening formed therein, the through opening having a plurality of teeth formed circumferentially therein. A plurality of wrench sockets are provided, each wrench socket having a first portion and an integral second portion. The first portion of each wrench socket has an exterior portion formed with a gear adapted to cooperate with the teeth in the opening in the head, the gears on the wrench sockets being identical. The second portion of each wrench socket has a bore formed therein, the bore being a polygonal socket for engaging a nut or bolt head. Each wrench socket has a first means cooperating with a second means in the opening in the head for releasably retaining a selected one of the wrench sockets therein. In this manner, when the selected wrench socket is disposed in the head, all of the teeth in the head cooperate with the gear on the socket thereby providing a strong contact therebetween permitting breaker bar action on the nut or bolt head.

These and other objects of the present invention will become apparent from a reading of the following specification taken in conjunction with the enclosed drawings.

DESCRIPTION

In a typical low profile ratchet wrench of the prior art, the body and head of the wrench have a reduced height as compared to a conventional ratchet wrench, enabling the low profile ratchet wrench to be used in confined spaces. However, the typical low profile ratchet wrench has an extending tang which is received in a cooperating opening in the center of a conventional socket. Thus, the height of the body of the wrench has been reduced but the socket remains a limiting feature on the overall height of the system.

The ratchet wrench of the present invention has overcome this deficiency by the use of a socket which incorporates the drive gear as an integral part of the socket and which is used with a unique removable pawl module.

Figure 1:
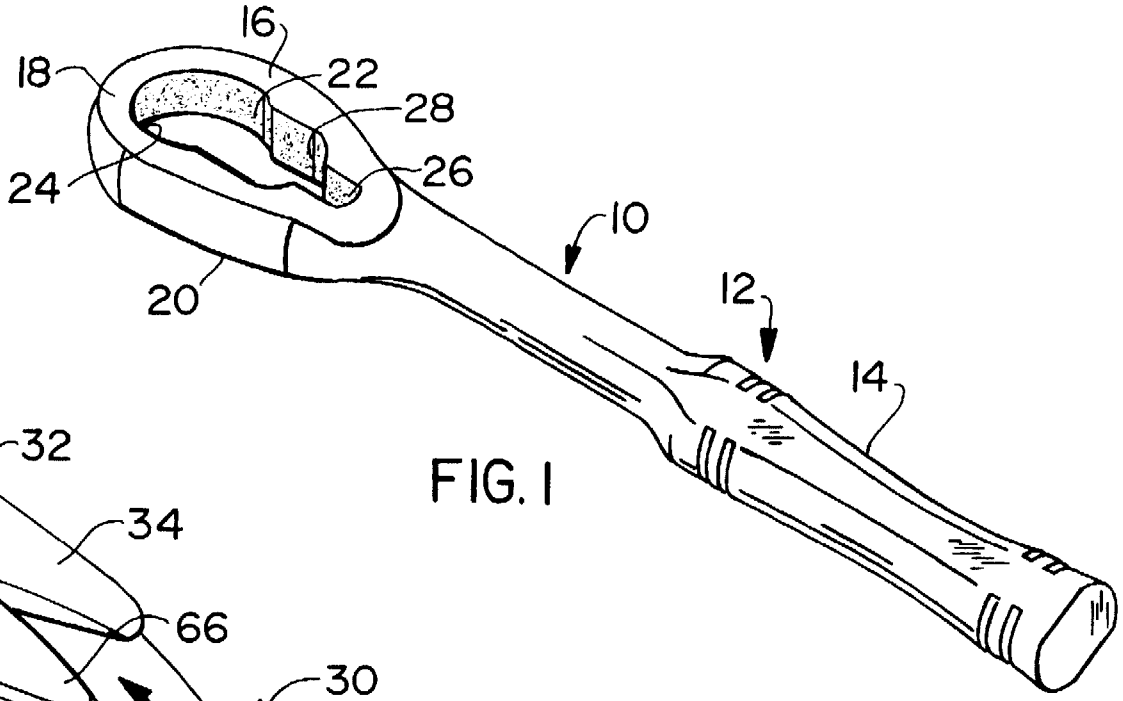
FIG. 1 is a perspective view of the body of the wrench of the present invention.
Figure 2:
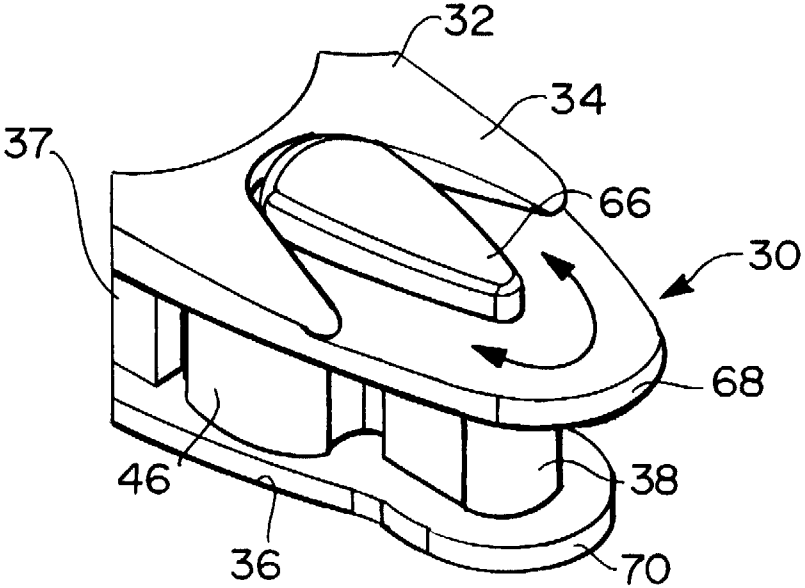
FIG. 2 is an enlarged perspective view of the pawl module.
Figure 3:
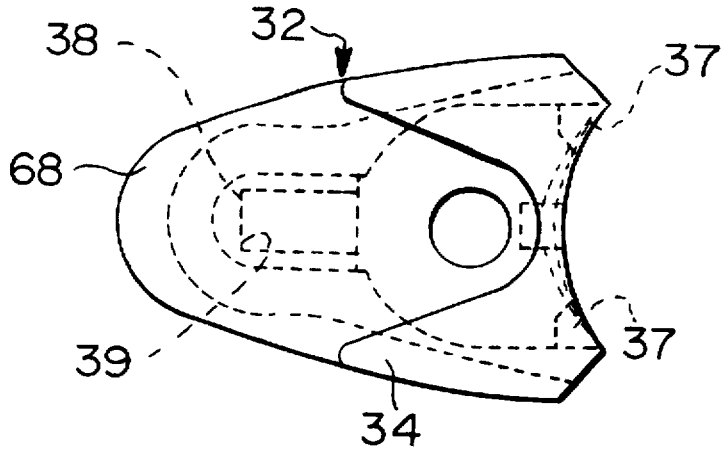
FIG. 3 is a top plan view of the body of the pawl module.
Figure 4:
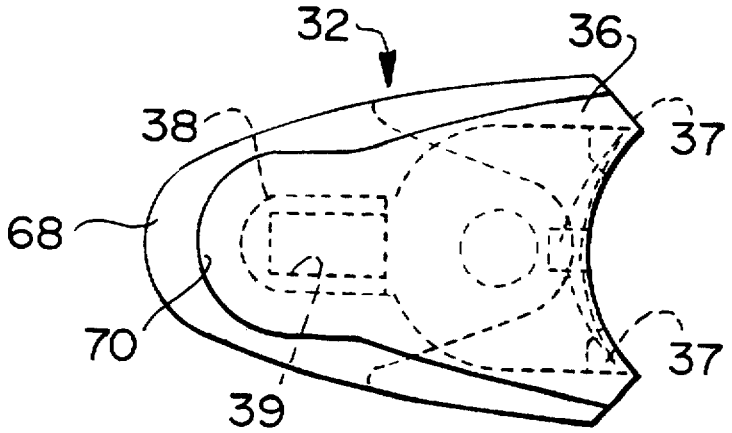
FIG. 4 is a bottom plan view of the body of the pawl module.
Figure 5:
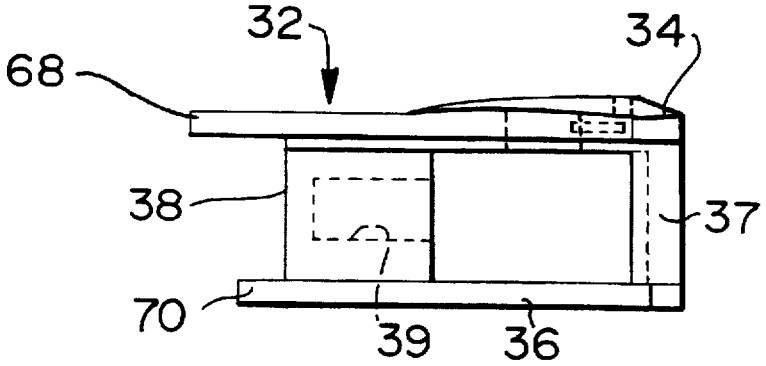
FIG. 5 is a side elevation view of the body of the pawl module.
Figure 6:
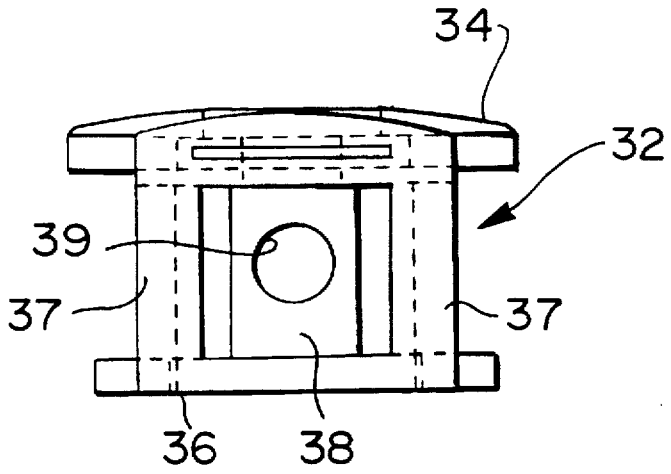
FIG. 6 is a front view of the body of the pawl module.
Figure 7:
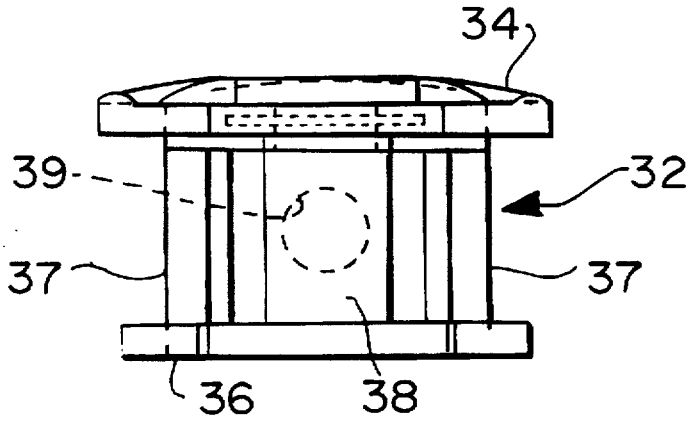
FIG. 7 is a rear view of the body of the pawl module.

Referring now to FIG. 1, the low profile ratchet wrench 10 of the present invention has a body 12 which has a handle 14 and a through the head 16, from the upper face 18 to the lower face 20. The opening 22 has at least two and preferably three interconnecting portions. The first, larger portion 24 of the opening 22 is distal from the handle 14 and the second, smaller portion 26 of the opening 22 is proximal to the handle 14. The third, intermediate portion 28 of the opening 22 is between the first and second portions of the opening 22 and has a size intermediate of the first and second portions. It is preferred that the first portion 24 of the opening be substantially circular and that the second portion 26 of the opening have an arcuate end joining a pair of approximately parallel walls.

Figure 8:
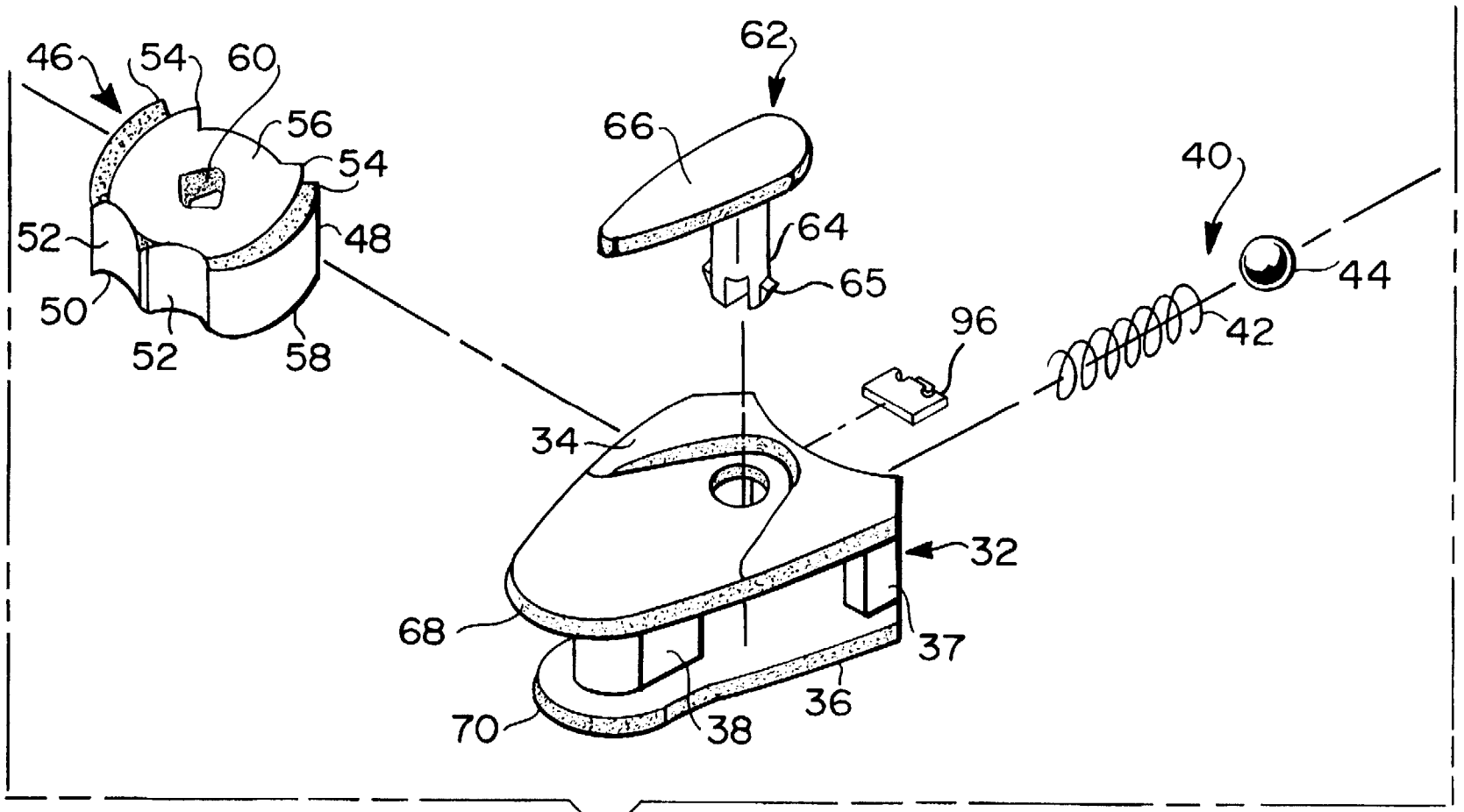
FIG. 8 is an exploded view of the pawl module.
Figure 10:
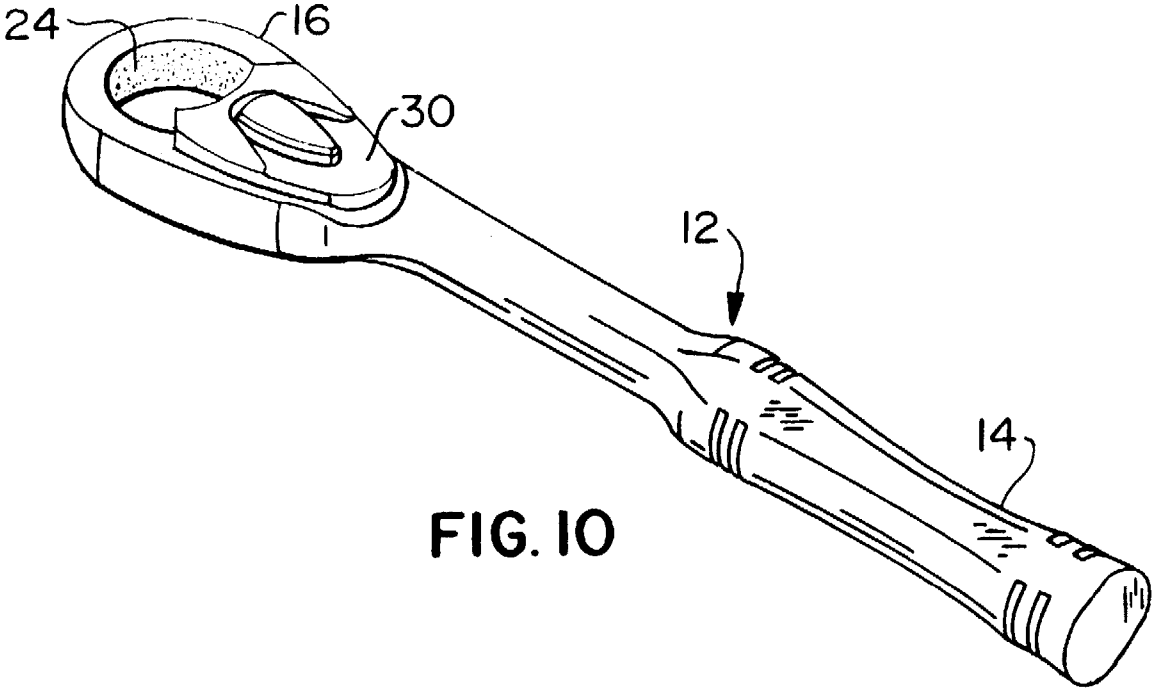
FIG. 10 is a perspective view showing the pawl module received in the head of the wrench.
Figure 9:
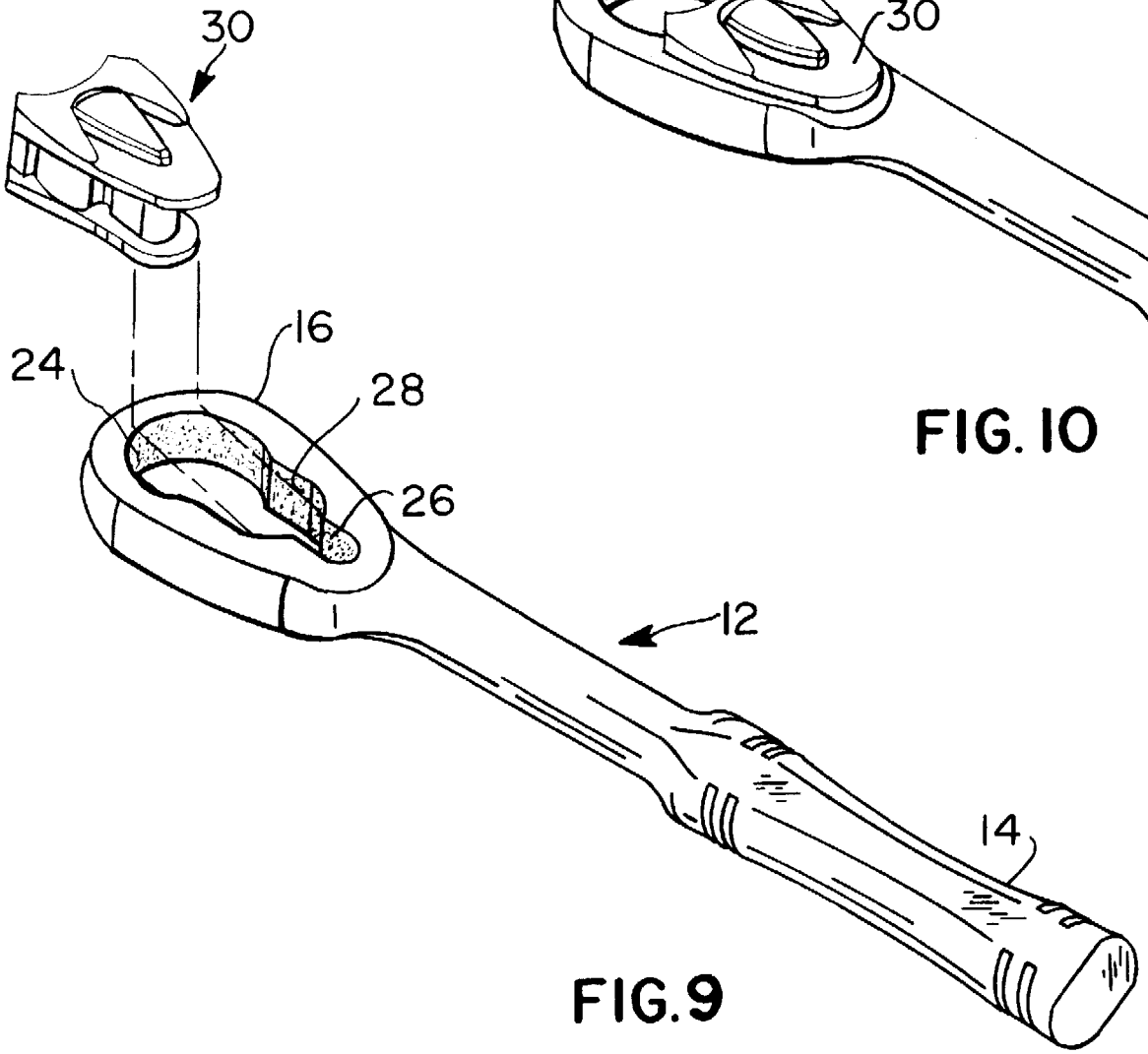
FIG. 9 is a perspective view showing insertion of the pawl module into the head of the wrench.

A self contained reversing pawl module 30 is disposed in the third portion 28 and the smaller, second portion 26 of the opening 22 as will be described and as shown in FIGS. 9–10. Referring to FIGS. 2–8. The pawl module 30 has a body 32 formed of a rigid material such as plastic or metal. The body 32 has a top 34 and a bottom 36 and has a front which is wider than a back. The top 34 and bottom 36 are connected, preferably by a pair of separated posts 37 at the front and by a stanchion 38 at the back. The number of posts and the configuration of the stanchion may be changed and the pawl module body 32 is not so limited. A bore hole 39 is formed in the stanchion 38 oriented toward the posts 37. The bore hole 39 is approximately parallel to, or at a slight angle to, the bottom 36 of the body 32. A detent means 40 such as a spring 42 and ball 44 or similar means is disposed in the bore hole 39. A pawl 46 which has a first face 48 and an opposite second face 50 is disposed in the body 32 of the pawl module 30. The second face 50 has formed therein a pair of adjacent pockets 52 separated by a wall. The detent means 40 is received in and cooperates with a selected one of the pockets 52 and is urged against the second face 50 of the pawl by the spring 42 or corresponding component of the detent means 40. A plurality of teeth 54 are formed on the first face 48 of the pawl 46. The pawl 46 further has a top 56 and a bottom 58. It is preferred that the pockets 52 and the teeth 54 all extend fully between the top 56 and the bottom 58 of the pawl 46. An axial opening 60 is formed in the top 56 of the pawl 46, the opening preferably extending through the pawl 46 to the bottom 58. A reversing lever 62 has a stem 64 which is engageably received in the opening 60 in the pawl. The stem 64 is connected to a lever arm 66, the stem 64 extending through an opening in the pawl module body 32 and an aligned opening in the pawl 46. The stem 64 preferably has a bifurcated end 65 opposite from the lever 62. A short leg extends from each portion of the bifurcated end. The bifurcated end 65 is compressed as the stem 64 is inserted into the opening 60 in the pawl 46 and as the end of the stem 64 exits from the opening 60 into a recess in the pawl 46, the bifurcated end expands resiliently to engage the short leg on each portion with the recess in the pawl 46. In this manner, the lever 62 is connected to the pawl 46 (FIG. 8). Thus, when the lever arm 66 is moved left or right of a center position, the pawl 46 is similarly moved so that the detent means is received in a selected pocket 52 and a selected plurality of teeth 54 on the first face 48 of the pawl 46 is oriented outwardly of the pawl module 30 to engage gear teeth on the socket as will be described for forward and reverse movement of the socket.

The pawl module 30 may also be used with a ratchet wrench in which a gear having gear teeth is disposed in the head of the ratchet wrench. The gear drives a tang 67 to which a conventional socket 69 is removably attached. In this embodiment, the ratchet wrench may be either a conventional ratchet wrench or a low profile ratchet wrench.

The body 32 of the pawl module 30 has a first flange 68 formed as an extension of the top 34 and a second flange 70 formed as an extension of the bottom 36. The flanges 68, 70 are approximately parallel to one another and are oriented away from the pawl 46 and away from the front of the pawl module body. The pawl module body 32 is disposed in the second portion 26 and third portion 28 of the opening 22 in the head 16 such that the respective upper face 18 and the lower face 20 of the head of the wrench are received between the flanges 68, 70, the flanges 68, 70 being oriented away from the first portion of the opening 24. The stanchion 38 is disposed between the parallel walls of the second portion 26 of the opening 22. In this manner, the pawl module 30 is retained in the opening 26, 28 in the head 16 with the teeth 54 on the first face 48 of the pawl 46 oriented toward the first portion 24 of the opening 22 (FIGS. 9 and 10).

Figures 11, 12:
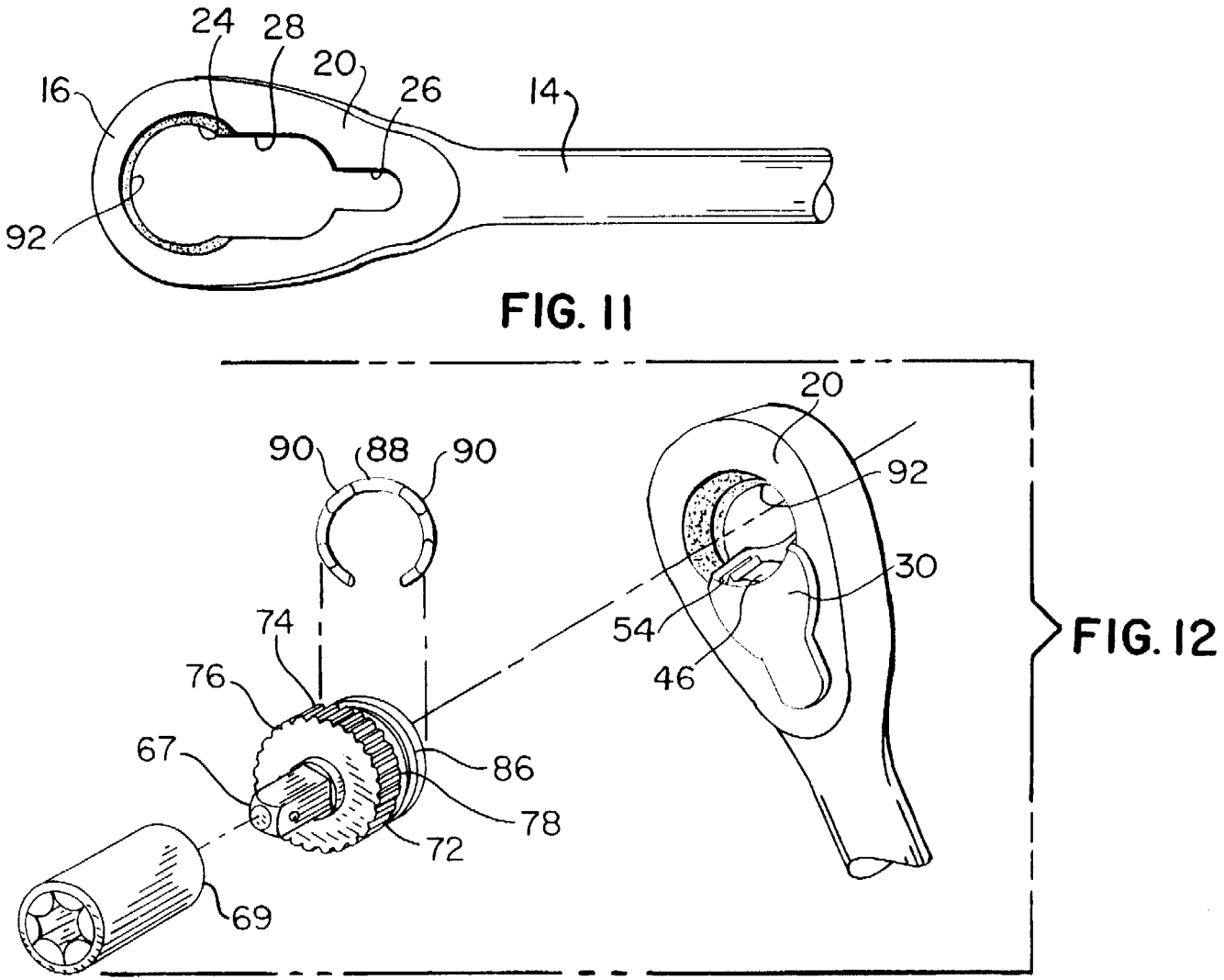
FIG. 11 is a bottom plan view of the head of the wrench.
FIG. 12 is an exploded perspective view showing insertion of the socket into the head of the wrench containing the pawl module.

As shown in FIG. 12, a socket 72 has a first portion 74 and a second integral portion 76. The first portion 74 has a plurality of gear teeth 78 formed circumferentially thereabout on the outer surface. The gear teeth 78 cooperate with the teeth 54 on the first face 48 of the pawl 46. The second portion 76 of the socket 72 has an opening 80 formed axially therein. The opening 80 has surfaces 82 therein which engage a fastener of a predetermined size. The surfaces 82 are of the type known to persons skilled in the art and may be of a conventional six point or twelve point type.

Figure 13:
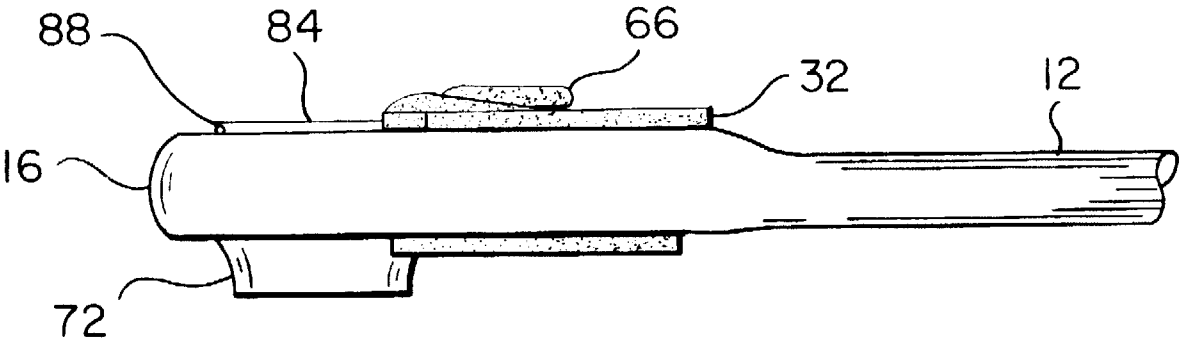
FIG. 13 is a side elevation view of the assembled ratchet wrench.
Figure 14:
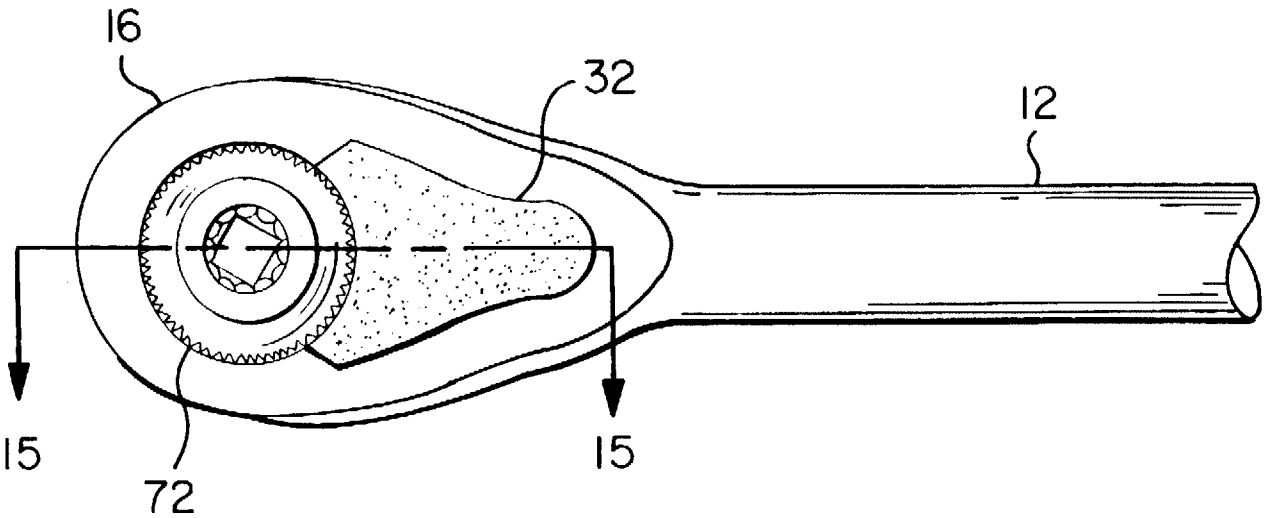
FIG. 14 is a bottom plan view of the assembled ratchet wrench.

The assembled ratchet wrench of the present invention is shown in FIGS. 13–14.

Several embodiments are available to retain the socket 72 in the head 16 of the wrench.

In one embodiment, the first portion 74 of the socket 72 has an upper surface 84. A channel 86 is formed circumferentially about the outer surface of the first portion 74 of the socket 72, preferably between the upper surface 84 and the gear teeth 78. A ring 88 is disposed in the channel 86. The ring 88 preferably is split, having a pair of unjoined ends and preferably having at least one lobe 90 formed thereon.

Figure 15:
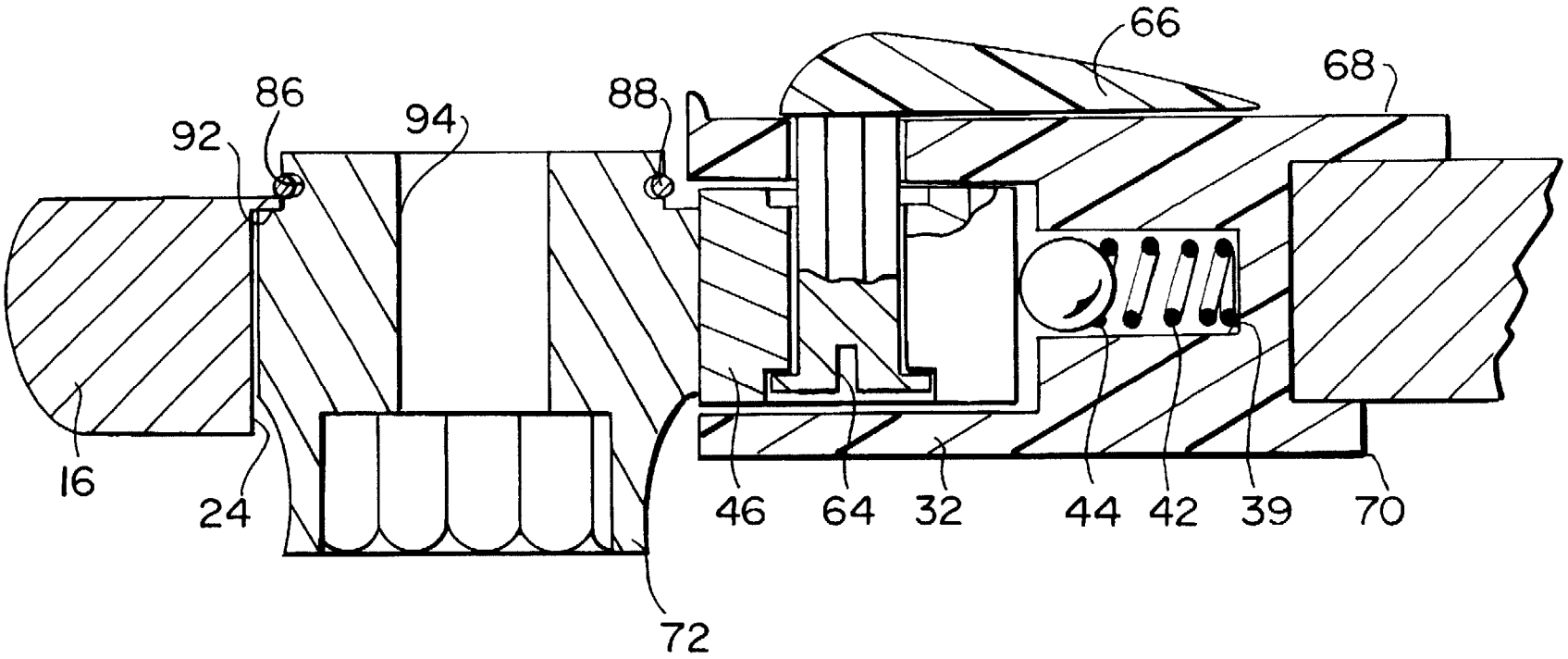
FIG. 15 is an enlarged cross-sectional view taken across the lines 15—15 of FIG. 14.
Figure 16:
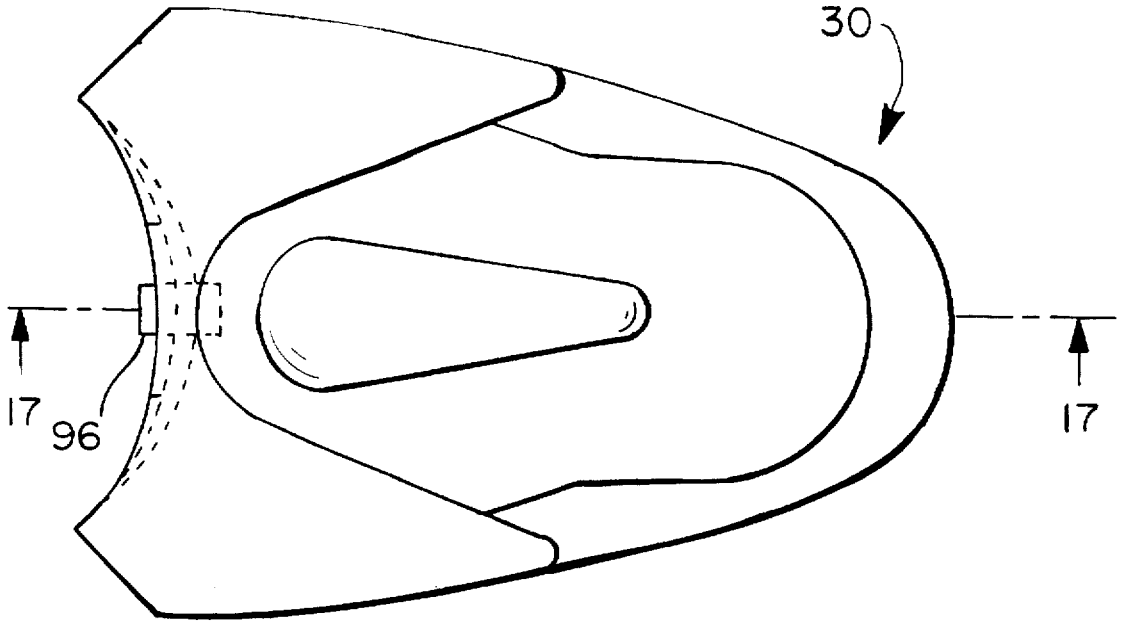
FIG. 16 is a top plan view of the pawl module showing a spring extending outwardly toward the socket.
Figure 17:
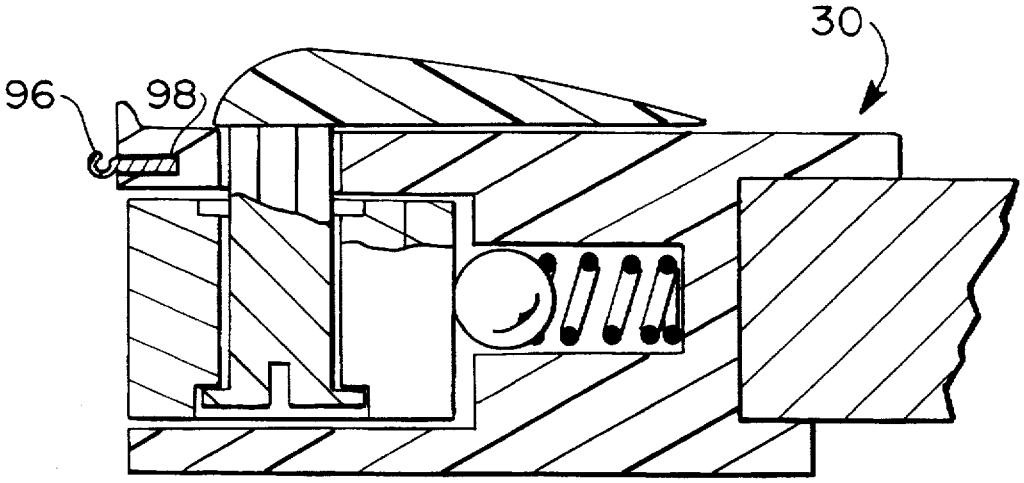
FIG. 17 is a cross section view taken across the lines 17—17 of FIG. 16.
Figure 18:
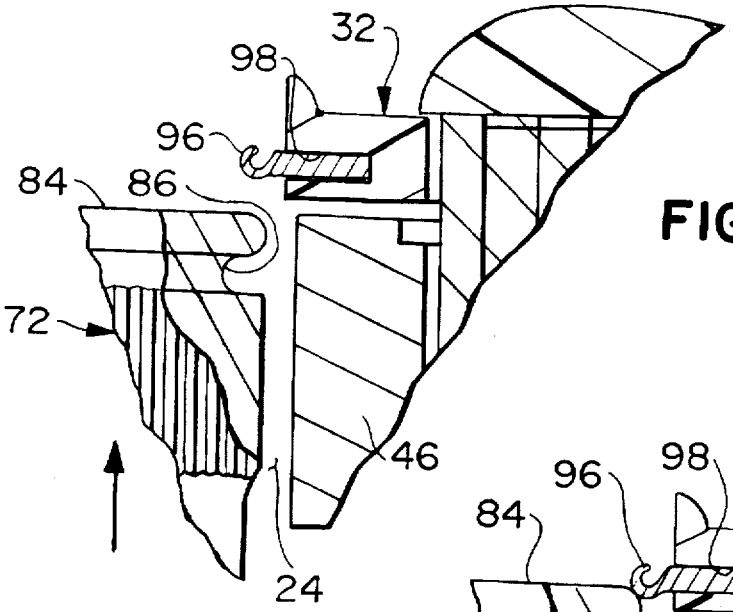
FIG. 18 is an enlarged partial cut-away side elevation view of the wrench showing the socket before contact with the spring on the pawl module.
Figure 19:
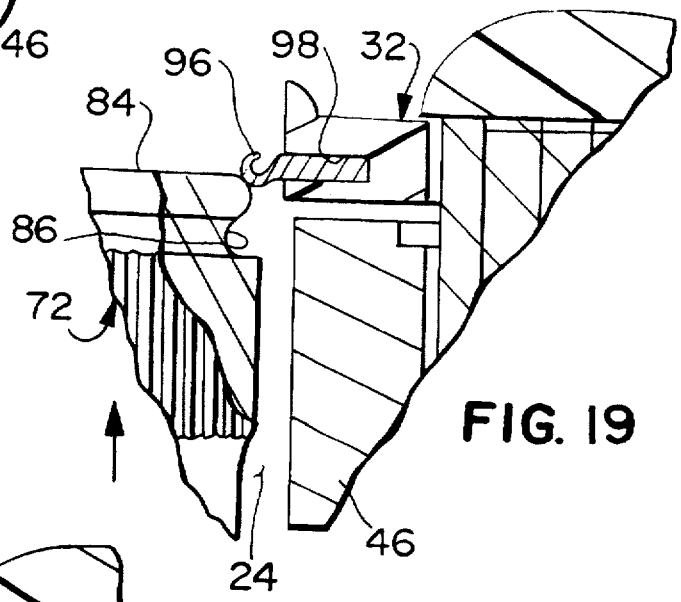
FIG. 19 is an enlarged partial cut-away side elevation view of the wrench showing the socket flexing the spring on the pawl module.
Figure 20:
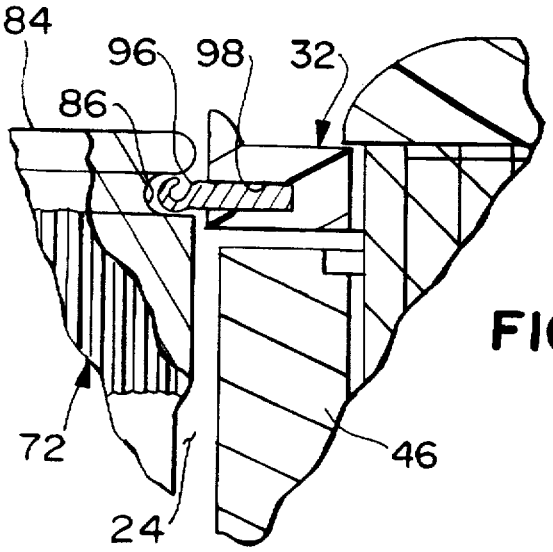
FIG. 20 is an enlarged partial cut-away side elevation view of the wrench showing the spring retaining the socket.
Figure 21:
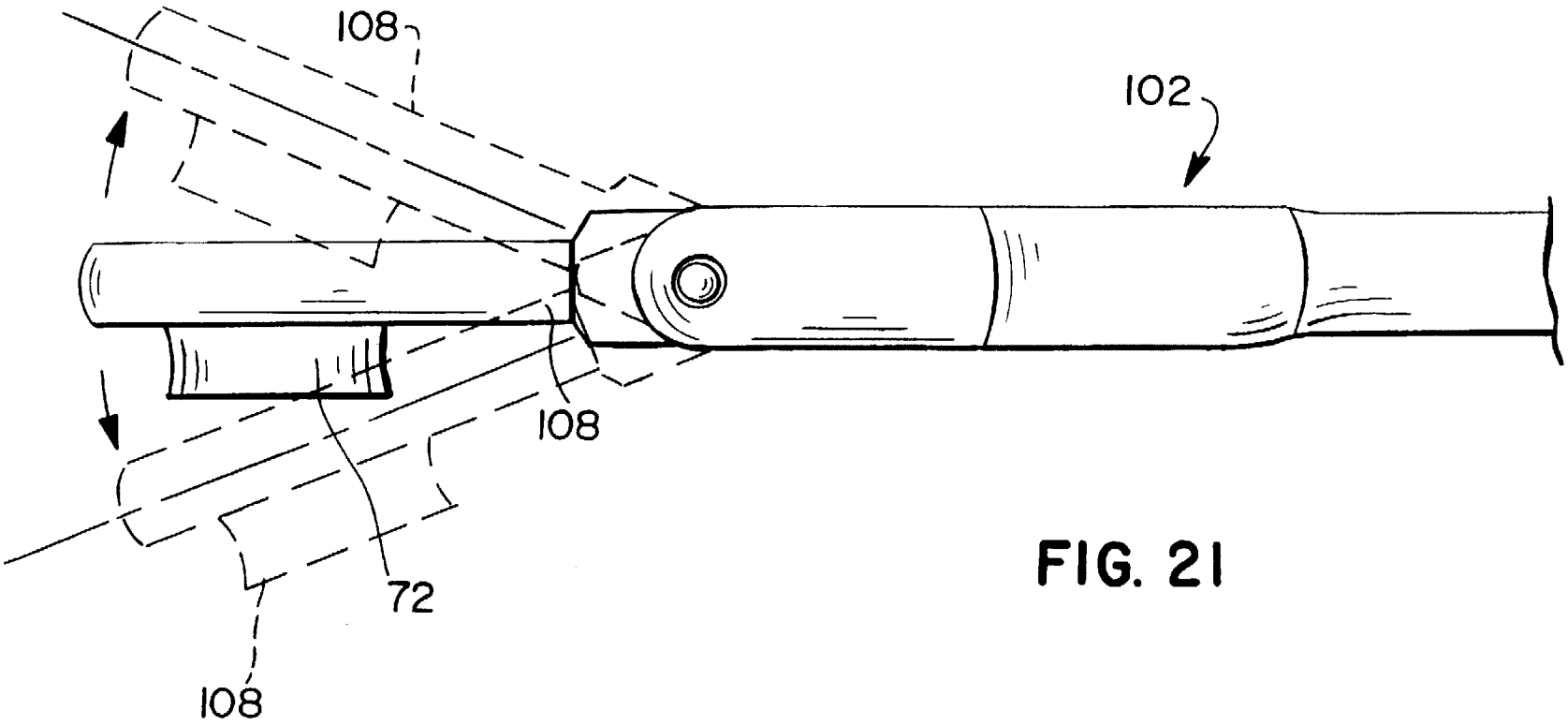
FIG. 21 is a perspective view of a breaker bar showing the head of the bar at an angle with respect to the handle.
Figure 22:
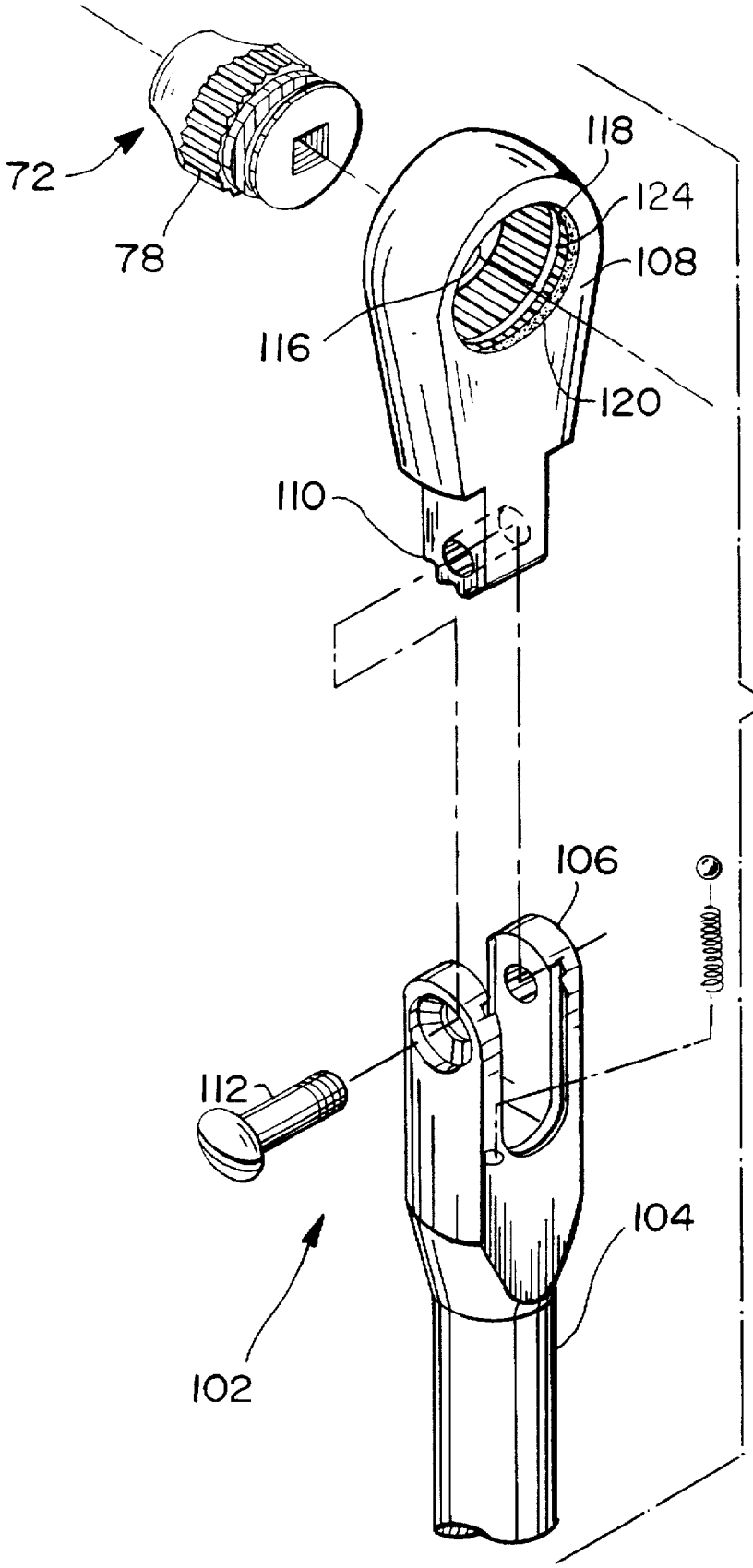
FIG. 22 is an exploded perspective view of the breaker bar showing the socket and the head of the breaker bar having cooperating teeth and a detent means for positioning the head of the breaker bar.
Figure 23:
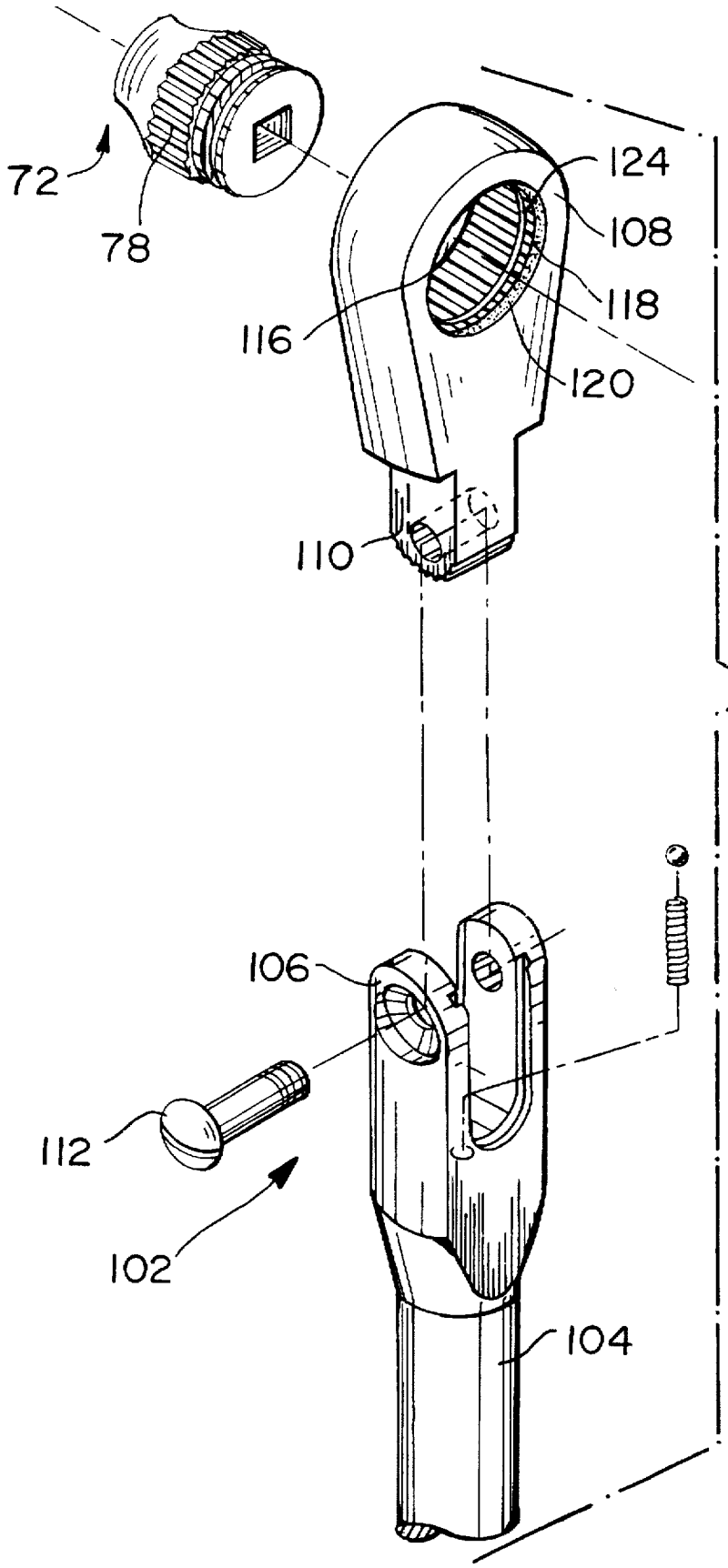
FIG. 23 is an exploded perspective view of the breaker bar of FIG. 22.

Alternately an elastomeric "O" ring may be used. As shown in FIGS. 11, 12 and 15, a retention lip 92 is formed at least partially circumferentially about the head 16 of the wrench, extending inwardly into the first portion 24 of the opening 22. The lip 92 provides a stop for the socket 72 and together with the ring 88, retains the socket 22 in the first portion 24 of the opening 22 (FIG. 15).

In a further embodiment (FIGS. 16–20) a spring with a radial end 96 is mounted in a recess 98 formed in the top 34 of the pawl module body 32. The spring 96 extends outwardly from the pawl module body 32 into the first portion 24 of the opening 22 in the head. Although it is preferred that spring 96 be mounted on the pawl module body 32, the spring 96 may be mounted in any manner whereby the spring 96 extends into the first portion 24 of the opening 22 where the spring 96 may engage the channel 86 in the socket 72. When the socket 72 is inserted into the opening 22, the spring 96 is deflected to permit the socket 72 to enter. The spring 96 resiliently recovers as the upper surface 84 of the socket 72 passes the spring 96 and the spring 96 enters the channel 86. The socket 72 is thereby retained within the opening 22 in the head 16 of the wrench. In removing the socket 72 from the wrench, the spring 96 is flexed and exits from the channel 86. The upper surface 84 of the socket 72 is moved past the spring 96 and the socket 72 is removed.

The ratchet wrench of the present invention is assembled by holding the integral pawl module 30 parallel with respect to the body 12 of the wrench and inserting the flanges 68, 70 on the pawl module 30 into the opening 22 in the head 16 of the body 12 (FIG. 9). The pawl module 30 is directed toward the handle 14 so that the stanchion 38 in the pawl module is received in the second portion 26 of the opening 22 and the flanges 68, 70 are oriented toward the handle 14, straddling the head 16 of the body 12. The lever arm 66 on the pawl module is placed in an intermediate midpoint position such that the detent means 40 is not disposed in either of the pockets 52 in the pawl but is directed against the wall between the pockets, and the teeth 54 on the first face 48 of the pawl 46 are not projecting outwardly from the pawl module 30 as in either the forward or reverse position of the lever arm 66 (FIGS. 9, 10). A selected socket 72 is inserted into the first portion 24 of the opening 22 in the head 16 of the wrench body 12 (FIG. 12). Since the teeth 54 on the first face 48 of the pawl 46 are not projecting outwardly, the gear teeth 78 on the socket 72 are not engaged and the socket 72 is easily inserted into the opening 22. The socket 72 is retained in the opening 22 by the retaining means previously described. The lever arm 66 is moved from the intermediate midpoint position to a forward or reverse position (as shown by the arrow in FIG. 2) so that the detent means 40 is disposed in one of the pockets 52 on the second face 50 of the pawl 46 and the teeth 54 on the first face 48 of the pawl 46 engage the gear teeth 78 on the socket 72. The ratchet wrench 10 of the present invention is ready for use.

In a similar manner, the ratchet wrench of the present invention can be easily assembled and disassembled by reversing the above steps. Thus, repairs, maintenance and routine cleaning are simple and can be accomplished rapidly with virtually no training.

The low profile ratchet wrench of the present invention offers many additional advantages over the prior art. The pawl module provides a relative inexpensive and simplified way to insert a pawl in a ratchet wrench. The need to bore a hole in the body of the wrench to receive a detent means has been eliminated. This is a costly procedure requiring drilling of each individual wrench. With the present invention, the body of the pawl module preferably is plastic which can be molded to incorporate the bore for the detent. Alternately, the plastic is easily drilled to obtain a bore which is approximately perpendicular to the pawl when the pawl is inserted. Further savings of manpower are achieved in the assembly of the wrench with the pawl module as compared to the prior art where insertion of the detent means and the pawl are tedious and time consuming. Further, the body of the wrench of the present invention may be produced more economically and more rapidly than the body of wrenches of the prior art. The ratchet wrench of the present invention has a lower profile than ratchet wrenches currently on the market which have replaceable sockets.

The socket 72 having gear teeth 78 on the exterior of the first portion 74 of the socket is also used in another embodiment (FIGS. 21–25). A breaker bar 102 has a handle 104, preferably having an integral yoke 106 at one end of the handle. A head 108 is attached to the handle 104. Preferably, the head has a hub 110 formed therein, the hub 110 being received within the yoke 106 and pivotally connected to the yoke 106 by a pin (or screw) 112 which extends through the yoke 106 and the hub 110. In this manner, the flex head 108 is angularly adjustable with respect to the handle 104. It is further preferred that the hub 110 have an arcuate edge with a plurality of teeth formed thereon. The teeth are oriented between the edges of the hub 110 so that the teeth are approximately perpendicular to the arms on the yoke 106 when the head 108 is disposed in the yoke 106. A detent means 128 is mounted in the base of the yoke 106 and is urged against the base of the head to retain the head in the selected position.

The head 108 further has a through opening 116 formed therein. A plurality of teeth 118 are formed circumferentially in the through opening 116. First means 120 are provided in the head 108 to cooperate with second means on the socket 72 for releasably retaining the socket 72 in the head 108. The first means 120 may be the lip on the head as previously described. The second means may be the ring or the channel on the socket as previously described.

Figure 24:
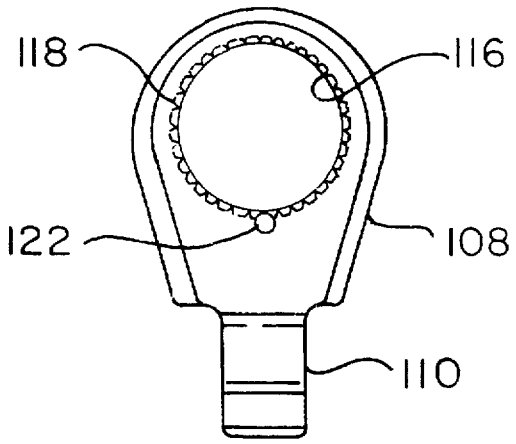
FIG. 24 is a top plan view of the head of the breaker bar showing an elastomeric plug disposed in a bore formed in the wall of the head and partially extending into the opening in the head.
Figure 25:
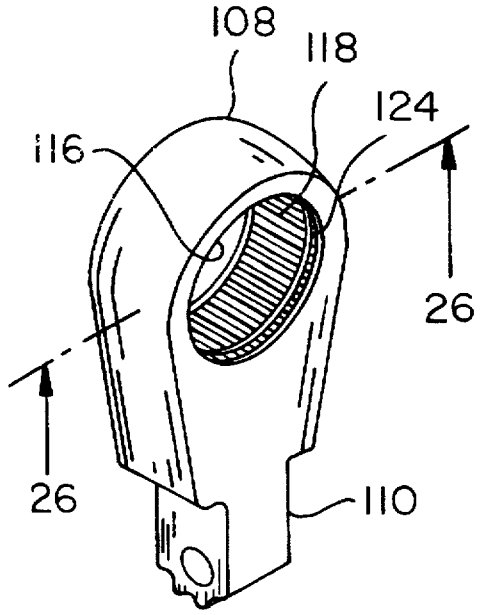
FIG. 25 is a perspective view of the head of the breaker bar showing a compressible ring disposed in a channel about the opening.
Figure 26:
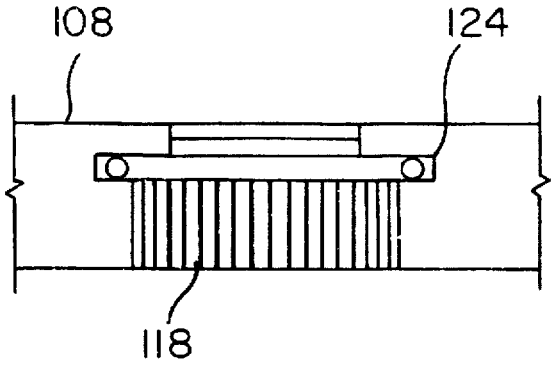
FIG. 26 is a cross-sectional view taken along the lines 25—25 of FIG. 24.

Alternately the first means may be an elastomeric plug 122 as shown in FIG. 24 which is disposed in a cavity in the wall of the opening 116 and which extends partially into the opening 116. The portion of the elastomeric plug 122 frictionally engages the teeth on the socket 72 and retain the socket. In another alternative, a channel 124 is formed circumferentially in the wall around the opening 116 in the head. A compressible ring 126 is disposed in the channel 124. The compressible ring 126 is the first means to retain the socket and the second means are the teeth on the socket which frictionally engage the compressible ring 126.

The gear teeth 72 on the wrench socket 72 cooperate with the teeth 118 in the opening 116 completely around the circumference of both the wrench socket 72 and the opening 116. In this manner there is a strong contact therebetween and forces applied to the handle are fully transmitted to the nut or bolt head which is disposed in the socket. In prior art, where a pawl is used in the wrench or similar device, the force is transmitted only by a minimum number of teeth such as the pawl teeth, and there is a possibility that the teeth may be damaged.

The present invention provides more positive and full drive of a socket on a nut or bolt head than the prior art and utilizes a versatile tool which can also be used as a wrench socket. A plurality of the sockets are provided permitting the single breaker bar to be used for nuts and bolt heads of varying sizes.

Obviously, many modifications may be made without departing from the basic spirit of the present invention.

Accordingly, it will be appreciated by those skilled in the art that within the scope of the appended claims, the invention may be practiced other than has been specifically described herein.

I claim:

1. A low profile ratchet wrench comprising a handle and a head, the head having an upper face and a lower face, an opening formed through the head between the upper face and the lower face, the opening having a first portion distal from the handle, a second portion proximal to the handle, and an intermediate portion therebetween, all of the portions communicating with one another, a socket removably received in the first portion of the opening in the head, the socket having a plurality of gear teeth formed circumferentially thereabout, a self contained pawl module received in the intermediate and second portions of the opening in the head, wherein the pawl module cooperates with the gear teeth on the socket, the pawl module having a body, a pawl being disposed in the body, a bore hole formed in the body and a detent means disposed in the bore hole.

2. The wrench of claim 1, the pawl module further comprising the body having a top and a bottom, the detent means being urged against and engaging a first face of the pawl, the teeth being formed on a second opposite face of the pawl, a reversing lever extending through the body and being received in an axial opening in the pawl, the body having a first flange formed on the top and a second parallel flange formed on the bottom, the body of the pawl module being received in the intermediate and second portions of the opening in the head wherein the head of the wrench is disposed between the first flange and the second flange and the teeth on the pawl are oriented toward the first portion of the opening to permit engagement with the gear teeth on the socket.

3. The wrench of claim 1, the pawl module further comprising a reversing lever extending through the body and being received in an axial opening in the pawl, wherein the pawl may be rotated between a forward and a reverse position.

4. The wrench of claim 1, the pawl module further comprising the body having a top and a bottom, the body having a first flange formed on the top and a second parallel flange formed on the bottom, the body of the pawl module being received in the intermediate and second portions of the opening in the head wherein the head of the wrench is disposed between the first flange and the second flange, retaining the pawl module in the head of the wrench.

5. The wrench of claim 1, the pawl module further comprising the detent means being urged against and engaging a first face of the pawl, teeth being formed on a second opposite face of the pawl, the teeth on the pawl being oriented toward the first portion of the opening to permit engagement with the gear teeth on the socket.

6. The wrench of claim 1, the pawl module further comprising the pawl having a second face having a pair of adjacent pockets formed therein, the detent means being urged against the second face of the pawl and cooperating with the first or second pocket as desired, a reversing lever extending through the body and being received in an axial opening in the pawl wherein the reversing lever rotates the pawl to select the desired pocket.

7. The wrench of claim 1, further comprising the pawl module having a body having a top, a spring having a radial end being mounted in the top of the body, the radial end extending outwardly from the body toward the socket, the socket having a channel formed circumferentially about an outer surface of the socket above the gear teeth, wherein the radial end of the spring is removably received in the channel in the socket to retain the socket in the first portion of the opening in the head.

8. A ratchet wrench having a head with an opening therein, a pawl module disposed in the opening in the head, the pawl module comprising:

a body having a pawl and a detent means disposed therein, a pair of spaced apart, substantially parallel flanges being formed on the body of the pawl module, the flanges extending outwardly from the body, the flanges straddling the head of the wrench wherein the pawl module is retained in the head of the wrench.

9. The ratchet wrench of claim 8, further comprising a bore hole formed in the body, a detent means disposed in the bore hole, the detent means being urged against and engaging a second face of the pawl, teeth being formed on a first opposite face of the pawl, the teeth on the pawl being oriented toward the opening in the head to permit engagement with gear teeth for driving a socket.

10. The ratchet wrench of claim 9, wherein a gear having gear teeth therein is disposed in the head of the wrench, the gear driving a tang to which a conventional socket is removably attached.

11. The ratchet wrench of claim 9, wherein, the gear teeth are formed on an outer circumference of a socket which is removably disposed in the head of the wrench.

12. The ratchet wrench of claim 10, further comprising the body of the pawl module having a top, a spring having a radial end being mounted in the top of the body, the radial end extending outwardly from the body toward the socket, the socket having a channel formed circumferentially about an outer surface thereof, wherein the radial end of the spring is removably received in the channel in the socket to retain the socket in the head of the wrench.

13. The ratchet wrench of claim 8, further comprising the pawl having a second face having a first and a second adjacent pockets formed therein and a first opposite face having a plurality of teeth formed thereon, the plurality of teeth being oriented toward the opening in the head to permit engagement with gear teeth on a socket disposed in the head, a bore hole formed in the body, the detent means being disposed in the bore hole, the detent means being urged against the second face of the pawl and cooperating with the first or second pocket as desired, a reversing lever extending through the body and being received in an axial opening in the pawl wherein the reversing lever rotates the pawl to select the desired pocket, the pawl thereby being in a forward or a reverse position.

14. The ratchet wrench of claim 8, further comprising a reversing lever extending through the body and being received in an axial opening in the pawl, wherein the pawl may be rotated between a forward and a reverse position.

15. A low profile ratchet wrench comprising a handle, an integral head, a socket and a self-contained pawl module, the head having an upper face and a lower face, an opening being formed through the head between the upper face and the lower face, the socket being received in the opening distal from the handle, the socket having a plurality of gear teeth formed circumferentially thereabout, means for releasably retaining the socket in the opening in the head, the pawl module being received in the opening proximal to the handle, the pawl module having a body, a bore hole formed in the body, a detent means disposed in the bore hole, a pawl being disposed in the body, the detent means being disposed in the pawl body juxtapositioned to the pawl and urging the pawl to cooperate with the socket, a reversing lever being received in the pawl and pivotally moving the pawl between a forward and a reverse position.

16. A ratchet wrench having a head with an opening therein, a self-contained pawl module disposed in the opening in the head, the pawl module comprising:

a body, a bore hole formed in the body, a detent means disposed in the bore hole, a pawl disposed in the body juxtapositioned to the detent means, and means to retain the pawl module in the opening in the head of the wrench.

17. The ratchet wrench of claim 16, wherein a pair of spaced-apart, substantially parallel flanges are formed on the body of the pawl module, the flanges extending outwardly from the body of the pawl module, the flanges straddling the head of the wrench wherein the pawl module is retained in the head of the wrench.

* * * * *